US009433550B2

(12) United States Patent
Winternheimer et al.

(10) Patent No.: US 9,433,550 B2
(45) Date of Patent: Sep. 6, 2016

(54) TRACTION BED

(71) Applicant: Country View Medical Center, Wheaton, IL (US)

(72) Inventors: Jeff Winternheimer, Wheaton, IL (US); Christopher R. Gray, Ashfield, MA (US)

(73) Assignee: Country View Medical Center, Wheaton, IL (US)

( * ) Notice: Subject to any disclaimer, the term of this patent is extended or adjusted under 35 U.S.C. 154(b) by 586 days.

(21) Appl. No.: 13/841,519

(22) Filed: Mar. 15, 2013

(65) Prior Publication Data

US 2013/0226060 A1 Aug. 29, 2013

Related U.S. Application Data

(63) Continuation-in-part of application No. 13/480,541, filed on May 25, 2012, now Pat. No. 9,114,051.

(60) Provisional application No. 61/490,400, filed on May 26, 2011.

(51) Int. Cl.

| | |
|---|---|
| ***A61H 23/00*** | (2006.01) |
| ***A61G 13/00*** | (2006.01) |
| ***A61H 1/00*** | (2006.01) |

(Continued)

(52) U.S. Cl.

CPC ..... *A61G 13/009* (2013.01); *A61H 1/005* (2013.01); *A61H 1/0222* (2013.01); *A61H 23/00* (2013.01); *A61H 2023/0281* (2013.01); *A61H 2201/1246* (2013.01); *A61H 2201/163* (2013.01); *A61H 2201/1616* (2013.01); *A61H 2201/501* (2013.01); *A61H 2201/5002* (2013.01); *A61H 2201/5005* (2013.01)

(58) Field of Classification Search

CPC .. A61H 23/00; A61H 23/0218; A61H 1/001; A61H 1/005; A61H 1/006; A61H 1/0222; A61H 2201/1246; A61H 2201/1616; A61H 2201/5002; A61H 2201/5005; A61H 2201/201; A61H 2201/163; A61H 2201/0233; A61H 2201/1621; A61H 2201/501; A61H 2023/0281; A61G 13/009

See application file for complete search history.

(56) References Cited

U.S. PATENT DOCUMENTS

| | | | |
|---|---|---|---|
| 3,238,936 | A | 3/1966 | Siedentop |
| 4,880,230 | A | 11/1989 | Cook |
| 5,181,904 | A | 1/1993 | Cook et al. |

(Continued)

FOREIGN PATENT DOCUMENTS

| | | |
|---|---|---|
| WO | 2005067860 | 7/2005 |

*Primary Examiner* — Quang D Thanh

(74) *Attorney, Agent, or Firm* — McDonnell Boehnen Hulbert & Berghoff LLP

(57) ABSTRACT

A traction bed includes (a) a frame upon which an individual is supportable, (b) a first single-sided lever arm pivotably coupled to the frame at a location proximate both a first end of the frame and a first side of the frame, wherein the first single-sided lever arm is configured to be coupled to an arm of an individual, (c) a second single-sided lever arm pivotably coupled to the frame at a location proximate both a second end of the frame and the first side of the frame, wherein the second single-sided lever arm is configured to be coupled to a leg of an individual, and (d) a control system operable to direct a force onto each of the single-sided lever arms to pivot the single-sided lever arms relative to the frame, wherein the force directed to the first single-sided lever arm is separately variable from the force directed to the second single-sided lever arm.

17 Claims, 13 Drawing Sheets

(51) Int. Cl.
*A61H 1/02* (2006.01)
*A61H 23/02* (2006.01)

(56) References Cited

U.S. PATENT DOCUMENTS

| | | | | |
|---|---|---|---|---|
| 6,436,011 | B1 | 8/2002 | Cook | |
| 6,468,233 | B2 | 10/2002 | Cook | |
| 6,672,998 | B2 | 1/2004 | Cook | |
| 7,063,678 | B1 | 6/2006 | Cook | |
| 7,094,213 | B1 | 8/2006 | Cook | |
| 7,530,960 | B2 | 5/2009 | Cook | |
| 9,114,051 | B2 * | 8/2015 | Winternheimer | A61H 1/005 |
| 2002/0032103 | A1 | 3/2002 | Cook | |
| 2002/0049393 | A1 | 4/2002 | Cook | |
| 2002/0065173 | A1 | 5/2002 | Cook | |
| 2002/0065178 | A1 | 5/2002 | Cook | |
| 2006/0217640 | A1 * | 9/2006 | Trandafir | A61H 1/001 601/90 |
| 2007/0225626 | A1 | 9/2007 | Krompasick | |
| 2008/0132812 | A1 | 6/2008 | Cook | |
| 2010/0137759 | A1 | 6/2010 | Cook | |

* cited by examiner

TRACTION BED

CROSS-REFERENCE TO RELATED APPLICATIONS

This application claims priority to and is a continuation-in-part application of U.S. Non-provisional patent application Ser. No. 13/480,541 filed on May 25, 2012 that issued on Aug. 25, 2015 as U.S. Pat. No. 9,114,051, which in turn claims priority to U.S. Provisional Patent Application No. 61/490,400 filed on May 26, 2011, the entire content of which is incorporated herein by reference.

FIELD OF THE INVENTION

The present invention relates to therapeutic devices, and more particularly to traction beds for performing therapy on individuals.

BACKGROUND OF THE INVENTION

Traction beds are used for performing therapy on individuals having a myriad of injuries, pain, or other ailments. For example, traction beds are typically used for performing therapy on individuals having back pain to alleviate or reduce their back pain. Such therapy typically involves stretching the individual's back by placing the individual into a harness, then strapping the harness at four different locations (i.e., upper left/right and lower left/right locations) to respective lever arms on the traction bed, and actuating the lever arms to pull on the harness. Currently available traction beds are only capable of applying an equal force to the left and right sides of the harness to stretch the individual's back.

SUMMARY OF THE INVENTION

Such limited capability of currently available traction beds can sometimes prevent therapists from isolating a particular muscle or joint within an individual's back upon which to conduct therapy. The present invention provides a traction bed capable of applying individualized force to any of the lever arms so as to effect traction at targeted points of an individual's body to permit a therapist to more precisely isolate a particular muscle or joint within the individual's back, thereby increasing the efficiency of the therapy being performed on the individual. Conditions that may be treated include, but are not limited to, sciatica, herniated discs, spinal stenosis, and/or bulging discs.

Further, the vibration table may optionally be included as part of the traction table or as a standalone device. The vibration table of the present invention is advantageously arranged to provide uniform vibration characteristics across a vibration platform to account for the loading position of a patient on the platform. Also, the vibration table provides a benefit in the form of vibration and/or actuation in a single axis. The vibration table offers a further benefit in the form of fully variable control of vibration magnitude independent of vibration frequency. In addition, the vibration table offers the benefit of manipulation of the input waveform beyond a basic sine wave, providing for standard waveforms square, triangular, etc.) or composite waveforms multi-frequency, etc.).

The traction bed of the present invention includes a frame upon which an individual can be supported and two or four lever arms pivotably coupled to the frame associated with four locations on one or more harnesses in which the individual is placed. In the dual lever arm embodiment, the two lever arms are located on opposing ends of the traction bed on a single side of the bed. The traction bed also includes a system for independently controlling the force applied to each of the lever arms such that the force is separately variable in each of the lever arms. Consequently, differential traction may be applied to an individual by exerting a larger force on the lever arms associated with one side of the individual's body, compared to the force exerted on the lever arms associated with the other side of the individual's body. Alternatively, crosswise differential traction may be applied to an individual's right upper torso and left pelvis, compared to the force exerted on the lever arms in communication with the individual's left upper torso and right pelvis. The traction bed optionally includes a vibration table upon which the individual may be supported. Such a vibration table may impart vibration to the individual along only a single axis (i.e., in a vertical direction). Such a vibration table may also exhibit substantially uniform vibration characteristics across the entire surface of the table upon which the individual may be supported.

The present invention provides, in one aspect, a traction bed including a frame upon which an individual is supportable, a first single-sided lever arm pivotably coupled to the frame at a location proximate both a first end of the frame and a first side of the frame, wherein the first single-sided lever arm is configured to be coupled to a location on an upper torso or an arm of an individual, a second single-sided lever arm pivotably coupled to the frame at a location proximate both a second end of the frame and the first side of the frame, wherein the second single-sided lever arm is configured to be coupled to a location on a lower torso, a pelvis or a leg of the individual, a control system operable to direct a force onto each of the single-sided lever arms to pivot the single-sided lever arms relative to the frame. The force directed to the first single-sided lever arm is separately variable from the force directed to the second single-sided lever arm.

The present invention provides, in another aspect, a traction bed including a frame upon which an individual is supportable, first and second lever arms pivotably coupled to the frame at a location proximate a first end of the frame and configured to be coupled to one or more locations on an upper torso or an individual's arms, third and fourth lever arms pivotably coupled to the frame at a location proximate a second end of the frame and configured to be coupled to one or more locations on a lower torso, a pelvis or the individuals legs, and a control system operable to direct a force onto each of the lever arms to pivot the lever arms relative to the frame. The force directed to each of the lever arms is separately variable.

The present invention provides, in a further aspect, a standalone vibration table including a platform movably coupled to the frame, a vibration device coupled to the platform, a linear motor, a linkage positioned between the frame and the platform, wherein the platform is supported upon the linkage, and wherein the linear motor actuates the linkage for displacing the platform along the single axis, and a controller for independently adjusting a frequency and magnitude of vibration imparted to the platform by the linear motor.

Other features and aspects of the invention will become apparent by consideration of the following detailed description and accompanying drawings.

DETAILED DESCRIPTION

Figure 1:
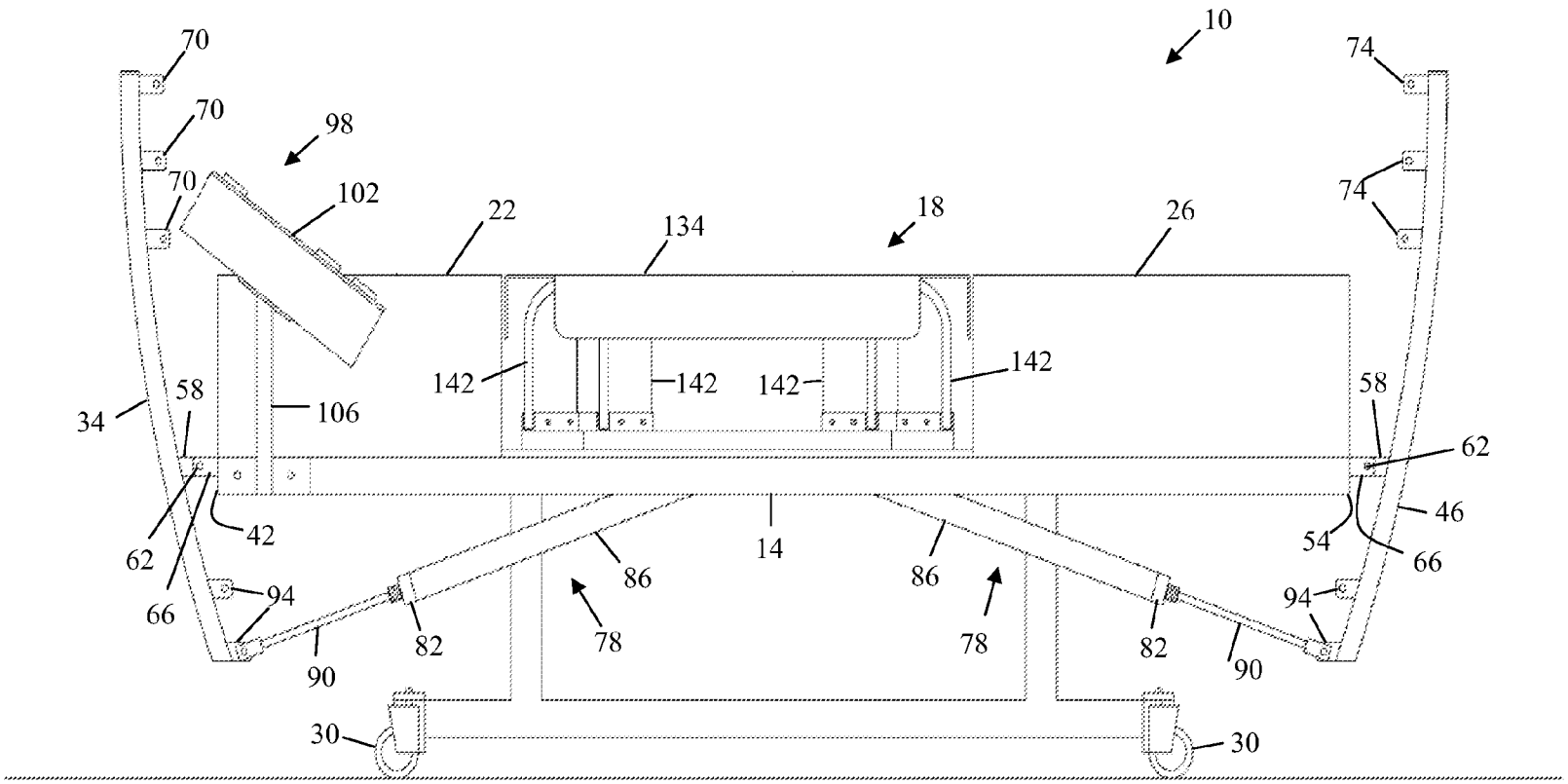
FIG. 1 is a left side view of a traction bed of the invention.
Figure 2:
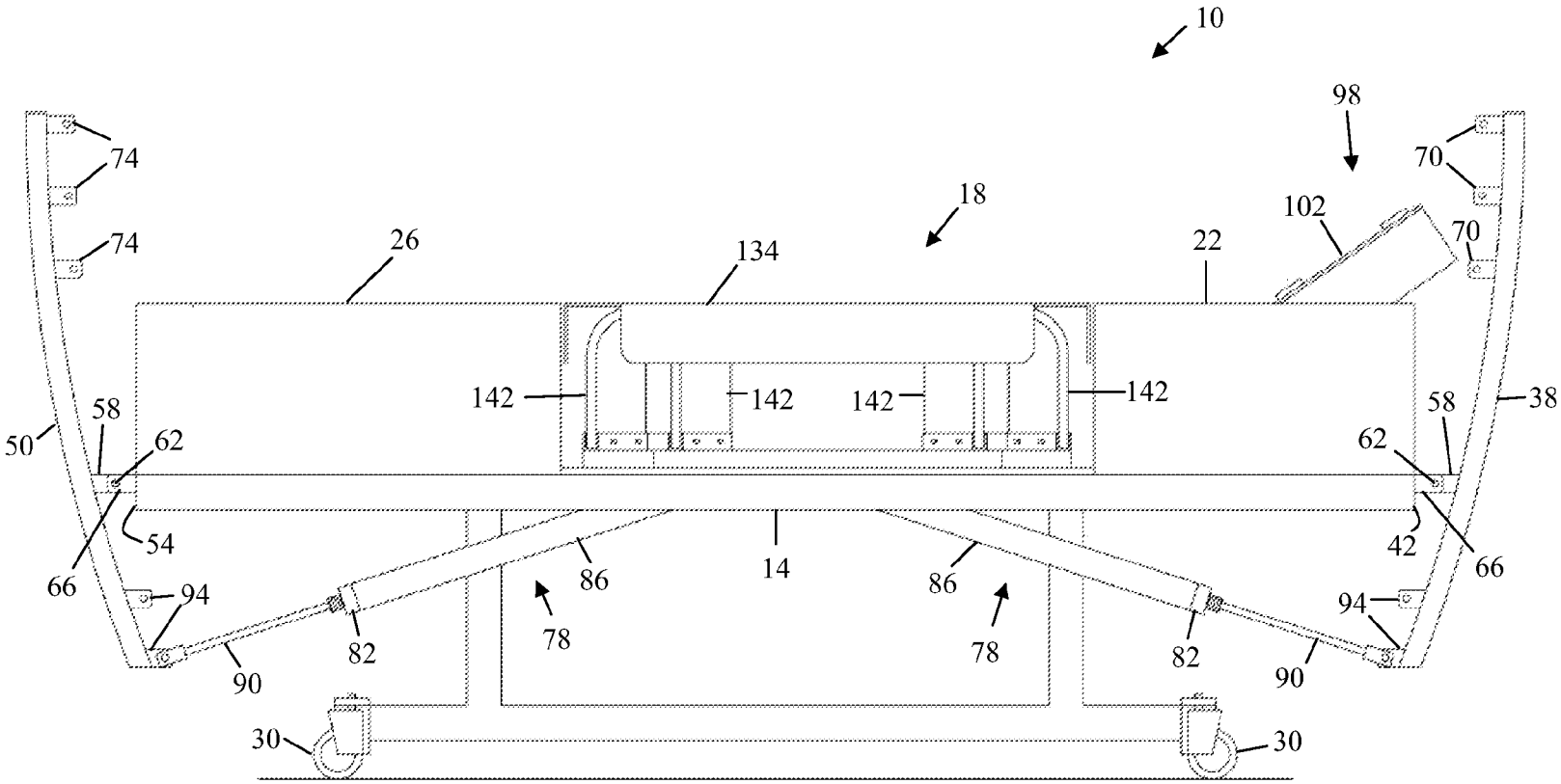
FIG. 2 is a right side view of the traction bed of FIG. 1.

FIGS. 1-5 illustrate a traction bed 10 including a frame 14 and a vibration table 18 positioned on the frame 14. As shown in FIGS. 1 and 2, the vibration table 18 is located in the middle of the frame 14, and respective head and leg cushions 22, 26 are located adjacent the vibration table 18 on either side of the table 18. As such, an individual laying on the traction bed 10 would have their head supported by the head cushion 22, their legs supported on the leg cushion 26, and their back supported by the vibration table 18. The top surface of the vibration table 18 is substantially coplanar with the top surfaces of the respective cushions 22, 26 such that the individual laying on the traction bed 10 is maintained in a substantially horizontal orientation. Alternatively, the vibration table 18 may be omitted in another construction of the traction bed 10. In the illustrated construction of the traction bed 10, the frame 14 includes a plurality of rollers 30 to facilitate moving the traction bed 10. Alternatively, the rollers 30 may be omitted.

Figure 3:
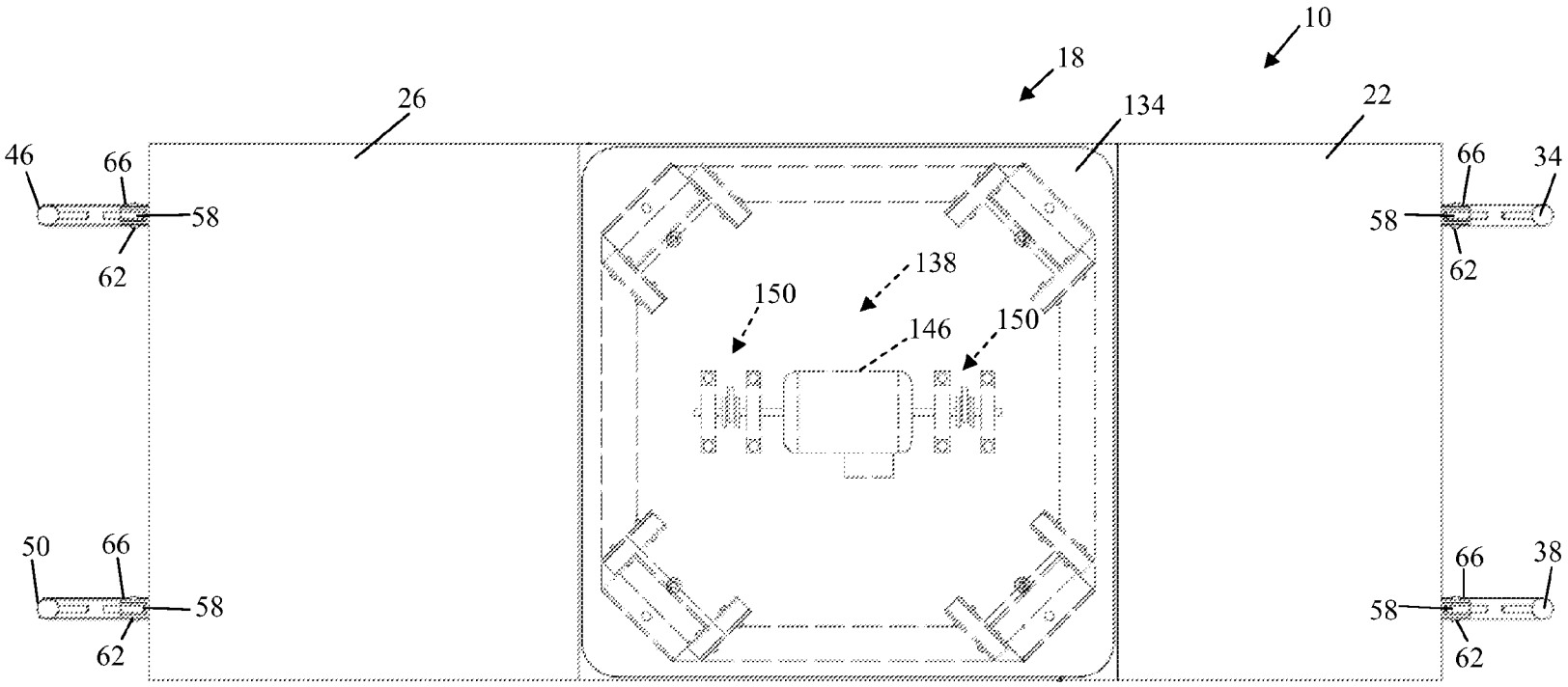
FIG. 3 is a top view of the traction bed of FIG. 1.

With reference to FIGS. 1 and 2, the traction bed 10 also includes first and second lever arms 34, 38 pivotably coupled to the frame 14 at a location proximate a first end 42 of the frame 14, and third and fourth lever arms 46, 50 pivotably coupled to the frame 14 at a location proximate a second end 54 of the frame 14. In the illustrated construction of the traction bed 10, each of the lever arms 34, 38, 46, 50 includes a pivot tab 58 having an aperture through which a pivot pin 62 is received. Each of the pins 62 is supported in a double-shear arrangement with corresponding brackets 66 attached to the frame 14 (FIG. 3). The pivot pins 62 associated with the first and second lever arms 34, 38 are substantially coaxial. Likewise, the pivot pins 62 associated with the third and fourth lever arms 46, 50 are substantially coaxial. Alternatively, any of a number of different structural arrangements may be utilized to pivotably couple the lever arms 34, 38, 46, 50 to the frame 14.

Figure 10:
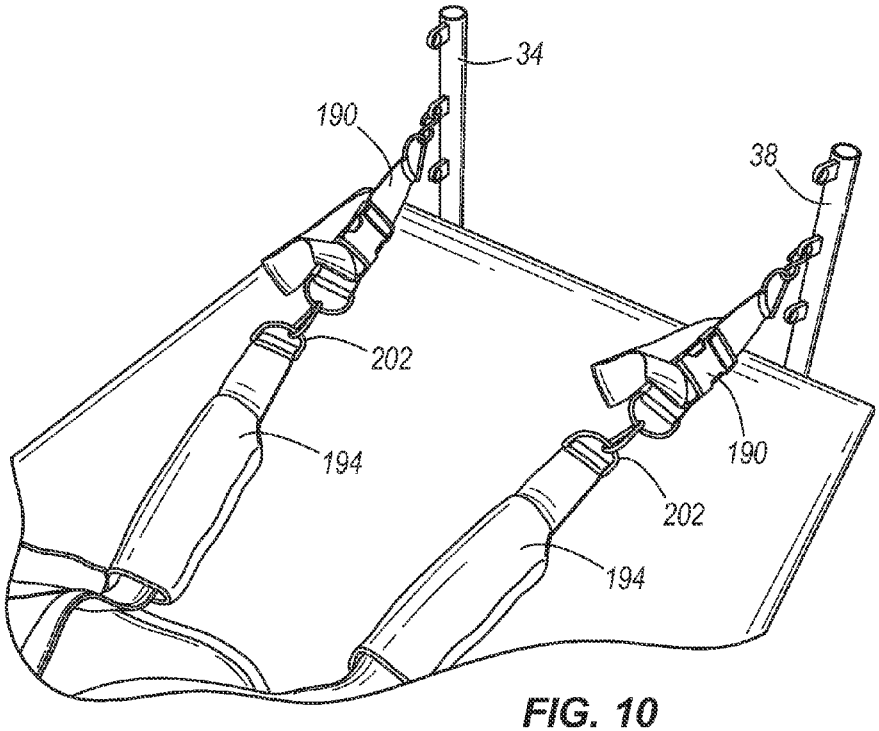
FIG. 10 is a perspective view of two intermediate straps interconnecting left and right-side shoulder straps of the harness to the traction bed of FIG. 1.

With reference to FIG. 10, respective intermediate straps 190 interconnect the first and second lever arms 34, 38 with right and left-side shoulder straps 194 of a harness 198 (e.g., an unweighting vest) in which an individual is placed prior to laying on the traction bed 10 to receive therapy. The shoulder straps 194 are attached to the harness 198 and coincide with the individual's upper torso, such that tensile forces developed in the straps 194 are ultimately transferred to the right and left-side of the individual's upper torso. The shoulder straps 194 each include a D-ring 202 to which the respective intermediate straps 190 are attached. Therefore, the D-rings 202 serve as upper right and left-side mounting points on the harness 198. Each of the first and second lever arms 34, 38 includes a plurality of tabs 70 spaced along the length of the arms 34, 38 to which the respective straps may be attached (FIGS. 1 and 2). Alternatively, the lever arms 34, 38 may each include only a single tab 70 for attaching the straps of the harness 198.

Figure 8:
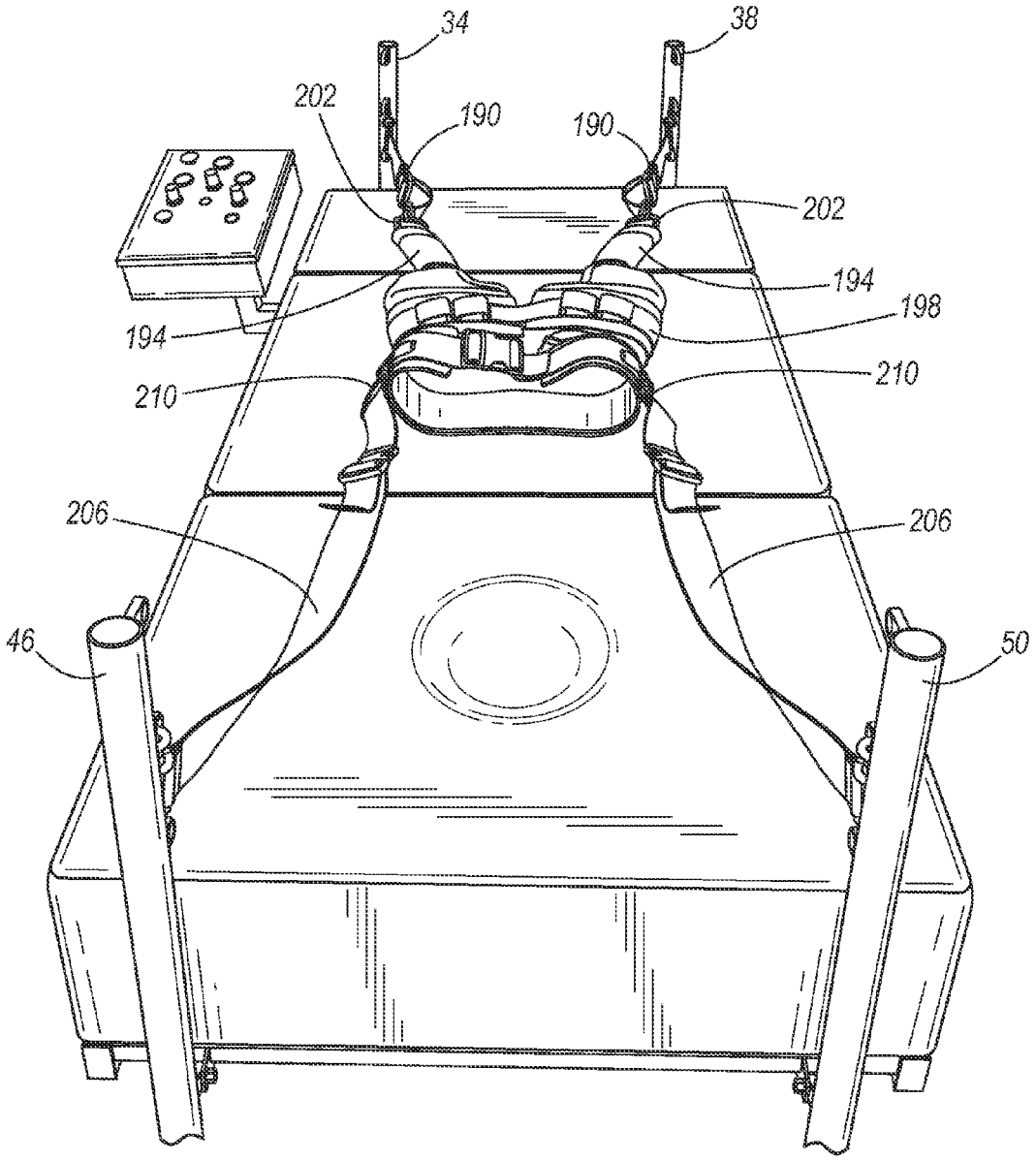
FIG. 8 is a perspective view of a harness in which an individual is placed prior to receiving therapy on the traction bed of FIG. 1.
Figure 9:
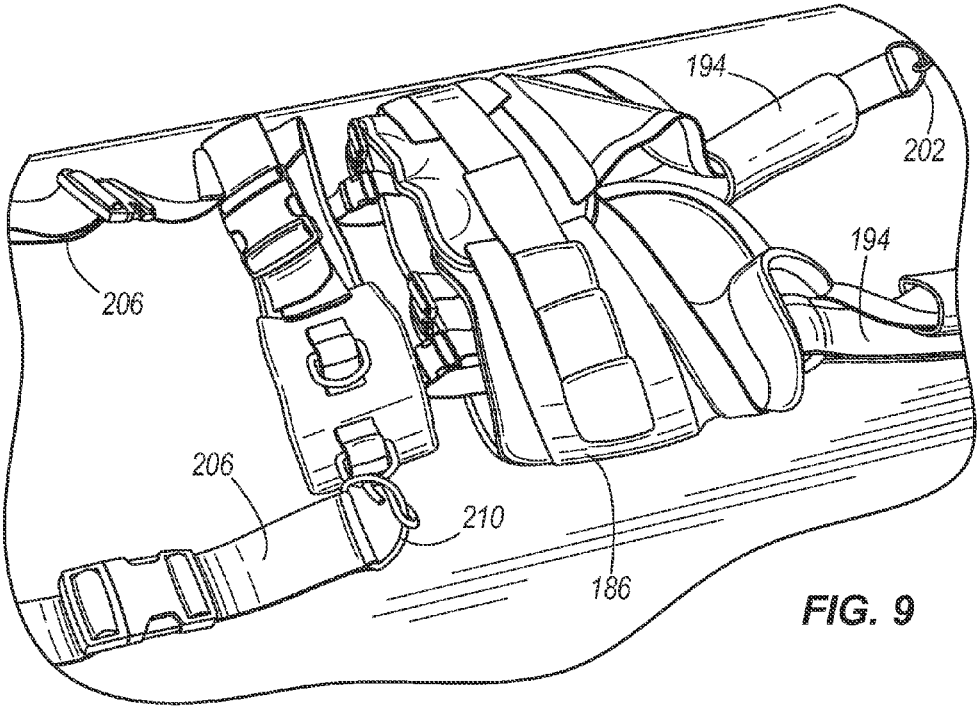
FIG. 9 is an enlarged perspective view of the harness of FIG. 8.

With reference to FIG. 8, respective straps 206 interconnect the third and fourth lever arms 46, 50 with right and left-side mounting points on a lower portion of the harness 198 coinciding with the individual's pelvis. In the illustrated construction of the harness 198, additional D-rings 210 (FIG. 9) serve as the lower right and left-side mounting points on the harness 198. As such, the tensile forces developed in the straps 206 are ultimately transferred to the right and left-sides of the individual's pelvis or pelvic region. Alternatively, the straps 206 may be interconnected to the lower portion of the harness 198 in any of a number of different ways. Each of the third and fourth lever arms 46, 50 includes a plurality of tabs 74 spaced along the length of the arms 46, 50 to which the respective straps may be attached (FIGS. 1 and 2). Alternatively, the lever arms 46, 50 may each include only a single tab 74 for attaching the straps of the harness 198.

With continued reference to FIGS. 1 and 2, the traction bed 10 further includes an extensible member 78 coupling each of the lever arms 34, 38, 46, 50, respectively, to the frame 14. In the illustrated construction of the traction bed 10, the extensible members 78 are configured as pneumatic cylinders 82 each having a housing 86 pivotably coupled to the frame 14 and a rod 90 pivotably coupled to an associated one of the lever arms 34, 38, 46, 50. Each of the lever arms 34, 38, 46, 50 includes a plurality of tabs 94 spaced along the length of the arms 34, 38, 46, 50 to which the rod 90 may be pivotably coupled. Alternatively, the lever arms 34, 38, 46, 50 may each include only a single tab 94 for attaching the rod 90. As a further alternative, the orientation of the pneumatic cylinders 82 may be reversed such that the rods 90 are pivotably coupled to the frame 14, and the housings 86 are pivotably coupled to the respective lever arms 34, 38, 46, 50. As will be discussed in more detail below, extension of the cylinders 82 causes the lever arms 34, 38, 46, 50 to pivot relative to the frame 14 such that upper ends of the respective lever arms 34, 38, 46, 50 move toward each other. Likewise, retraction of the cylinders 82 causes the lever arms 34, 38, 46, 50 to pivot relative to the frame 14 such that the upper ends of the respective lever arms 34, 38, 46, 50 move away from each other.

Figure 4:
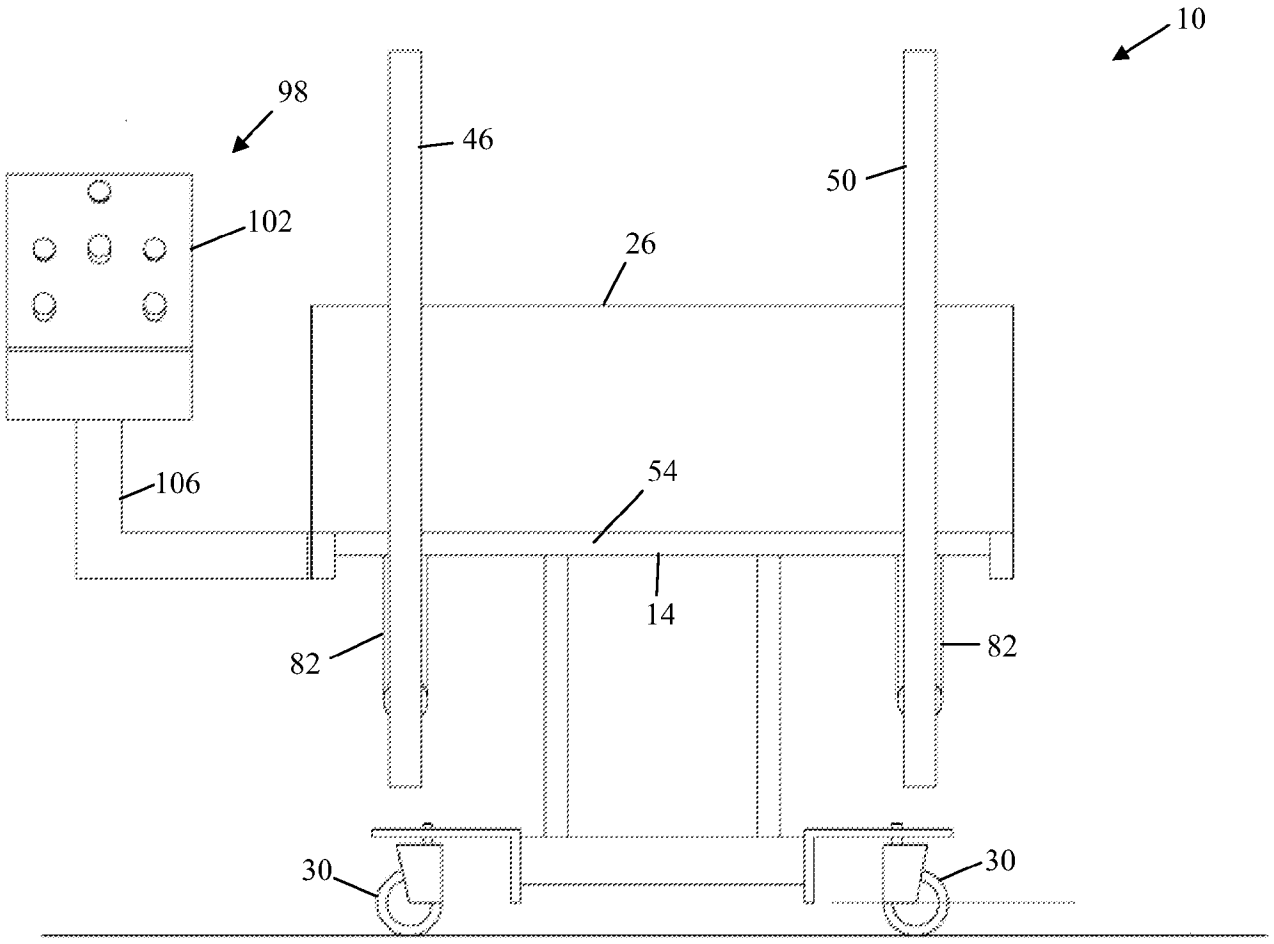
FIG. 4 is a front view of the traction bed of FIG. 1.
Figure 5:
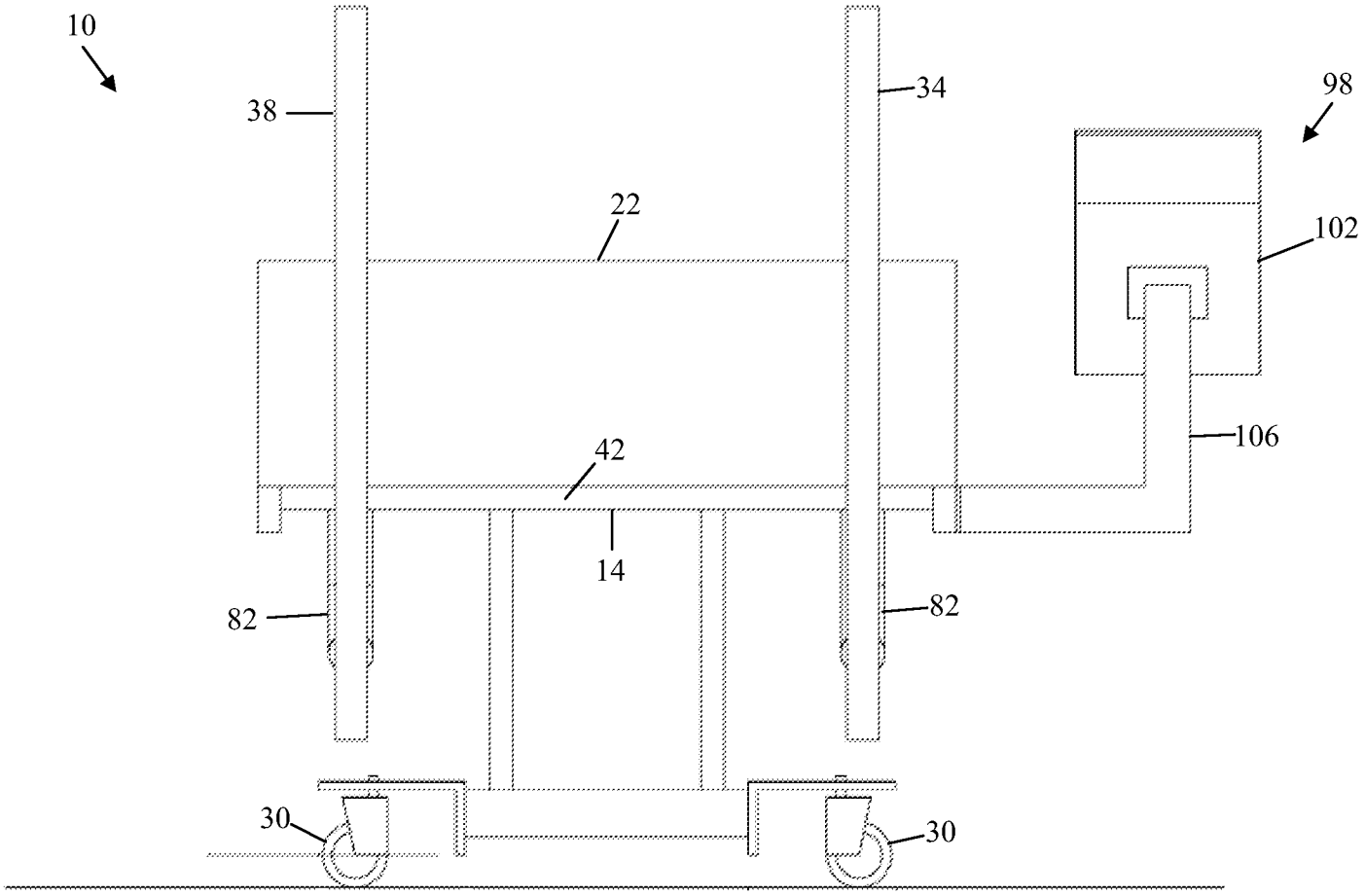
FIG. 5 is a rear view of the traction bed of FIG. 1.

With reference to FIGS. 1 and 4, the traction bed 10 includes a control system 98 operable to direct a force (e.g., via the pneumatic cylinders 82) onto each of the lever arms 34, 38, 46, 50 to pivot the lever arms 34, 38, 46, 50 relative to the frame 14. The force directed to the first and third lever arms 34, 46 is separately variable from the force directed to the second and fourth lever arms 38, 50 to provide differential traction to the left and right sides of an individual's body. Differential traction permits a therapist to more precisely isolate a particular muscle or joint within the individual's back, thereby increasing the efficiency of the therapy being performed on the individual. With reference to FIG. 4, the control system 98 includes a control panel 102 coupled to the frame 14 by a rigid support aim 106. Alternatively, the control panel 102 may be movably coupled to the frame 14 and adjustable relative to the frame 14.

Figure 6:
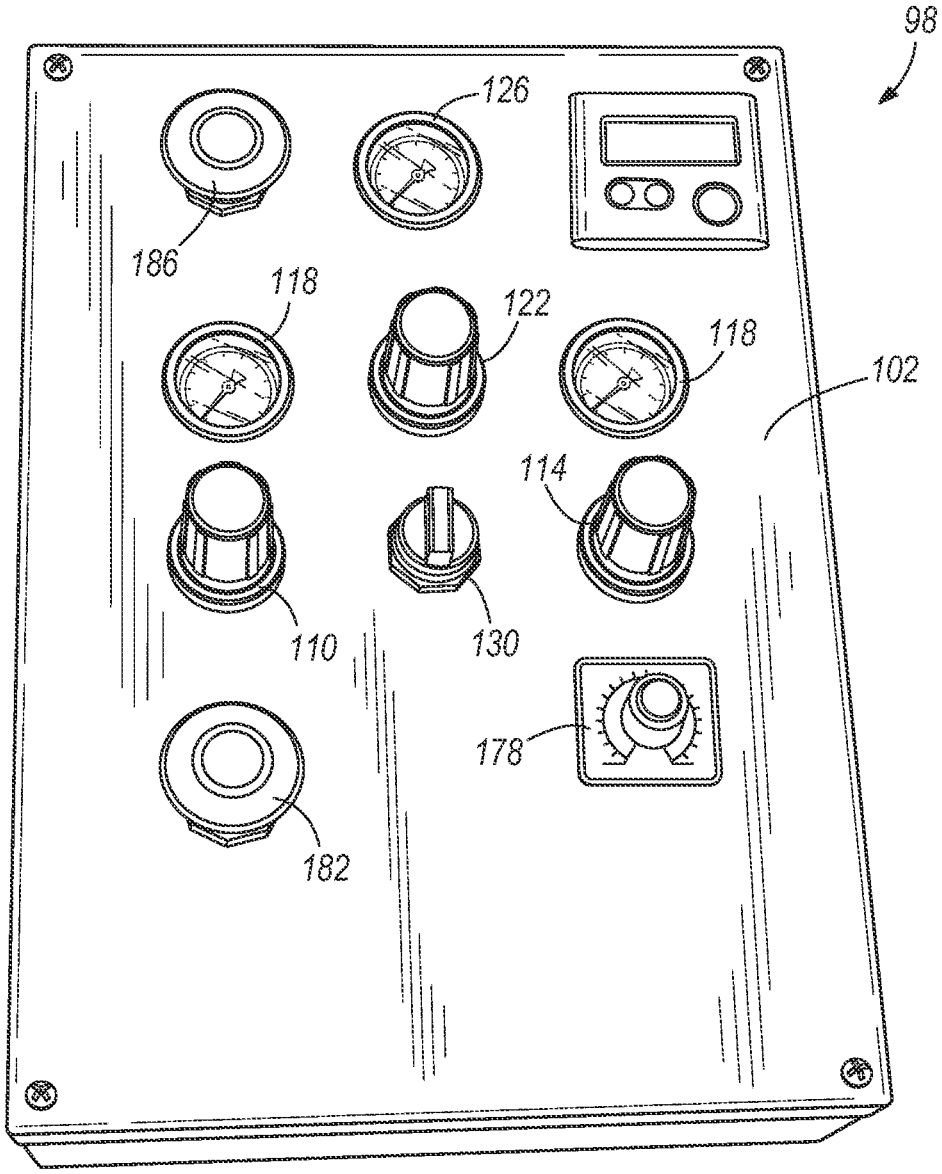
FIG. 6 is a perspective view of a control 5 stem of the traction bed of FIG. 1.

With reference to FIG. 6, the control system 98 includes a first pressure regulator 110 for varying an air pressure, or any compressed gas, delivered to the pneumatic cylinders 82 associated with the first and third lever arms 34, 46, and a second pressure regulator 114 for varying an air pressure delivered to the pneumatic cylinders 82 associated with the second and fourth lever arms 38, 50. Note that hydraulic systems could be utilized in other example embodiments. In the illustrated construction of the traction bed 10, the first and third lever arms 34, 46 are attached, respectively, to the right side of an individuals upper torso and pelvis via the harness 198 and the straps 190, 206, while the third and fourth lever arms 38, 50 are attached, respectively, to the left side of the individual's upper torso and pelvis via the harness 198 and the straps 190, 206. As such, the first pressure regulator 110 determines the air pressure delivered to the pneumatic cylinders 82 pulling (via the lever arms 34, 46) on the individual's right side, white the second pressure regulator 114 determines the air pressure delivered to the pneumatic cylinders 82 pulling (via the lever arms 36, 50) on the individual's left side. The control system 98 also includes pressure gauges 118 associated with the respective first and second pressure regulators 110, 114.

The control system 98 may further include a third pressure regulator 122 positioned upstream of the first and second pressure regulators 110, 114. The first and second pressure regulators 110, 114, therefore, are positioned downstream of the third pressure regulator 122 and in parallel with each other such that each of the first and second pressure regulators 110, 114 communicates independently with the third pressure regulator 122. The third pressure regulator 122 communicates with a source of pressurized air 124 (e.g., a portable or stationary air compressor) and is operable to set a maximum air pressure capable of being delivered to all of the pneumatic cylinders 82. The control system 98 also includes a pressure gauge 126 associated with the third pressure regulator 122 for displaying the maximum air pressure available to each of the cylinders 82.

With continued reference to FIG. 6, the control system 98 includes a multi-position valve 130 positioned downstream of the pressure regulators 110, 114, 122. The valve 130 includes a first or neutral position (shown in FIG. 6; see also position "1" in FIG. 7), in which all of the pneumatic cylinders 82 are communicated with only the third pressure regulator 122 to receive the maximum available air pressure. The valve 130 also includes a second position (i.e., rotated counter-clockwise from the neutral position to align with the first pressure regulator 110; see also position "2" in FIG. 7), in which the pneumatic cylinders 82 associated with the first and third lever arms 34, 46 communicate with the first pressure regulator 110 to receive a reduced air pressure, while the pneumatic cylinders 82 associated with the second and fourth lever arms 38, 50 are communicated with the third pressure regulator 122 to receive the maximum available air pressure. The difference in thickness of the lines leading to the pneumatic cylinders 82 are indicative of compressed air being delivered to the cylinders 82 at high and low pressures, respectively.

Figure 7:
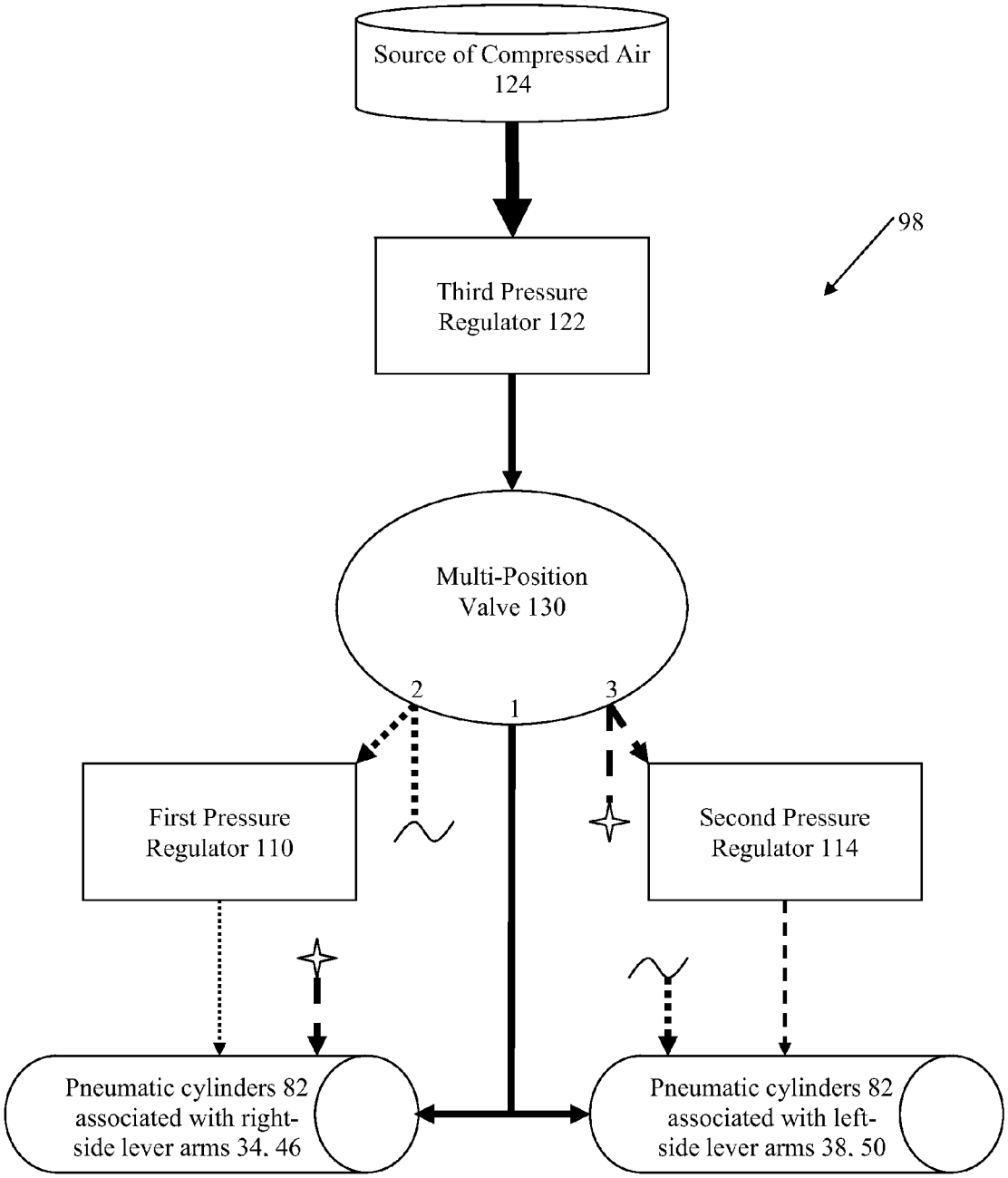
FIG. 7 is a schematic illustrating the control system of FIG. 6 interfacing with a plurality of pneumatic cylinders of the traction bed of FIG. 1.

The valve 130 also includes a third position (i.e., rotated clockwise from the neutral position to align with the second pressure regulator 114; see also position "3" in FIG. 7 in which the pneumatic cylinders 82 associated with the second and fourth lever arms 38, 50 communicate with the second pressure regulator 114 to receive a reduced air pressure, while the pneumatic cylinders 82 associated with the first and second lever arms 34, 46 communicate with the third pressure regulator 122 to receive the maximum available air pressure. The difference in thickness of the lines leading to the pneumatic cylinders 82 are indicative of compressed air being delivered to the cylinders 82 at high and low pressures, respectively. The control system 98 also includes a master power switch 134 to enable and disable the traction system including the pneumatic cylinders 82. When disabled, the cylinders 82 are vented to atmosphere, causing the rods 90 to extend and slacken the straps 190, 206 connected to the harness 198. Although not shown, the traction bed 10 includes air lines communicating the pneumatic cylinders 82 with the multi-position valve 130, and additional air tines communicating the pressure regulators 110, 114, 122 and the multi-position valve 130.

The combination of the multi-position valve 130 and the three pressure regulators 110, 114, 122 permits a different air pressure to be delivered to the pneumatic cylinders 82 associated with the first and third lever arms 34, 46 than that delivered to the pneumatic cylinders 82 associated with the second and fourth lever arms 38, 50. As such, a different force can be exerted on one side of an individual's body (e.g., via the first and third lever arms 34, 46) than that exerted on the other side (e.g., via the second and fourth lever arms 38, 50). The traction bed 10, therefore, is capable of applying a differential traction to the right and left sides of an individual's body, permitting a therapist to more precisely isolate a particular muscle or joint within the individual's back to increase the efficiency of the therapy being performed on the individual.

For example, when the multi-position valve 130 is in the neutral position shown in FIG. 6, the maximum available air pressure as determined by the third pressure regulator 122 is delivered to each of the pneumatic cylinders 82 (see also position "1" in FIG. 7). As a result, an equal amount of force is applied to each of the lever arms 34, 38, 46, 50, causing the first and third lever arms 34, 46 to pivot relative to the frame 14 and pull the right side of an individual's body, and causing the second and fourth lever arms 38, 50 to pivot relative to the frame 14 and pull the left side of the individual's body, an equal amount. When the valve 130 is rotated counter-clockwise from the neutral position to the second position (see position "2" in FIG. 7), less air pressure is delivered to the pneumatic cylinders 82 associated with the first and third lever arms 34, 46, causing the second and fourth lever arms 38, 50 to pull the left side of the individual's body with a greater force than that exerted by the first and third lever arms 34, 46 on the right side of the individual's body. Similarly, when the valve 130 is rotated clockwise from the neutral position to the third position (see position "3" in FIG. 7), less air pressure is delivered to the pneumatic cylinders 82 associated with the second and fourth lever arms 38, 50, causing the first and third lever arms 34, 46 to pull the right side of the individual's body with a greater force than that exerted by the second and fourth lever arms 38, 50 on the left side of the individual's body. Each of the pressure regulators 110, 114, 122 is adjustable to permit the therapist using the traction bed 10 to independently adjust the amount of traction or stretching delivered to an individual's right and left sides.

In an alternative construction of the traction bed 10, the control system 98 may be modified to independently control the force exerted by each of the pneumatic cylinders 82. As a result, crosswise differential traction may be applied to an individual in which, for example, the first and fourth lever arms 34, 50 pull harder on the individual's body than the second and third lever arms 38, 46. Likewise, the control system 98 may be adjusted to make the second and third lever arms 38, 46 pull harder on the individual's body than the first and fourth lever arms 34, 50. This can be accomplished by incorporating a fourth pressure regulator in the control system, such that each lever arm is controlled by its own pressure regulator. In this embodiment the third pressure regulator is assigned to a specific lever arm and does not function to evenly distribute pressure amongst all of the lever arms.

With reference to FIG. 3, the vibration table 18 includes a platform 134 movably coupled to the frame 14 and a vibration device 138 coupled to the platform 134. In the illustrated construction of the traction bed 10, the vibration table 18 includes a plurality of elastic rubber) mounts 142 (FIGS. 1 and 2) coupling the platform 134 to the frame 14. The mounts 142 are sufficiently rigid to support an individual's weight and maintain the top of the platform 134 substantially coplanar with the top surfaces of the respective cushions 22, 26, yet sufficiently flexible to permit some relative movement between the platform 134 and the frame 14. Alternatively, the platform 134 may be movably coupled to the frame 14 in any of a number of different manners that provide the same characteristics as the elastic mounts 142.

With reference to FIG. 3, the vibration device 138 includes an electric motor 146 and dual counterweight assemblies 150 driven by the motor 146. With reference to FIG. 6, the control system 98 includes a switch 178 operable to vary the speed of the motor 146 and therefore the frequency of vibration generated by each of the counterweight assemblies 150. As such, the therapist using the traction bed 10 may adjust the frequency of vibration of the platform 134 by adjusting the switch 178 depending on the desired therapy to be performed on an individual. The control system 98 also includes a switch 182 operable to activate and deactivate the vibration device 138. As such, the traction bed 10 may be used with or without vibration being generated by the vibration table 18. The control system 98 further includes another switch 186 for activating and deactivating the traction system including the extensible members 78. As such, the vibration table 18 may be employed without using the traction system.

Figure 11:
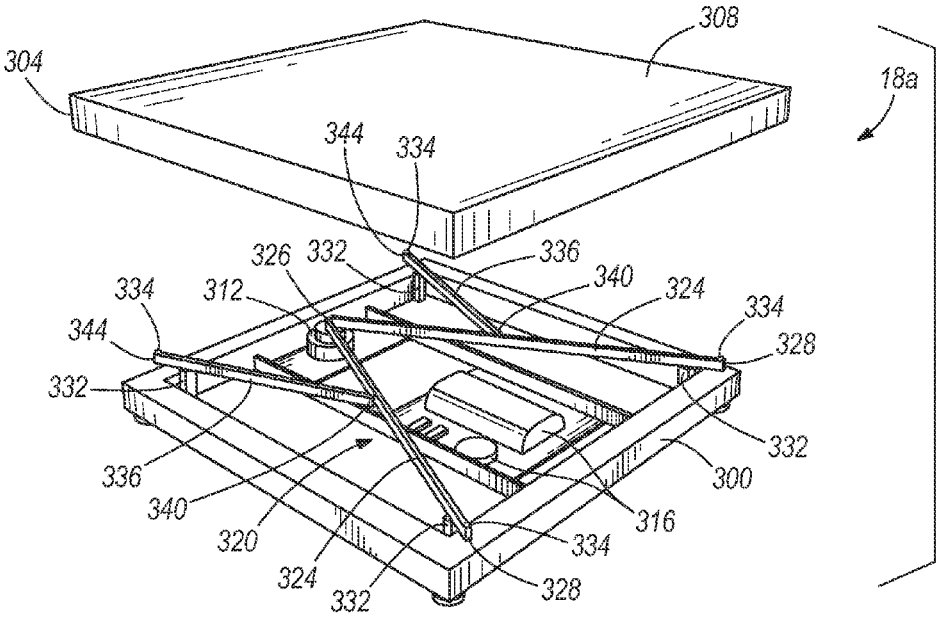
FIG. 11 is a partially exploded, perspective view of an alternative construction of a vibration table of the traction bed of FIG. 1.

In the illustrated construction of the traction bed 10, the vibration device 138 causes the platform 134 of the vibration table to vibrate both horizontally (i.e., within a plane parallel to the top surface of the platform) and vertically (i.e., normal to the aforementioned plane). In an alternative construction of the vibration table 18, the vibration device 138 may be designed to cause the platform 134 to vibrate in only a substantially vertical direction (i.e., up and down). Such a vibration table 18*a* is shown in FIG. 11. The vibration table 18*a* includes a frame 300 and a platform 304 upon which an individual is at least partially supported while receiving therapy. Although the vibration table 18*a* is described as a component of the traction bed 10, it should also be understood that the vibration table 18*a* can be used independently of the traction bed 10. For example, the vibration table 18*a* may be located on the ground, and the individual may stand on the platform 304 while receiving therapy.

With continued reference to FIG. 11, the frame 300 includes a sufficient mass to prevent the frame 300 from moving relative to the ground during operation. Likewise, the platform 304 must have an appropriate mass and rigidity to prevent the development of harmonics or nodes that affect the vibration behavior of the platform 304 while in operation. If the vibration table 18*a* is used independently of the traction bed 10, the platform 304 may include a surface finish or a coating on a top surface 308 of the platform 304 to enhance traction or grip on the surface 308 for an individual standing on the platform 304. Otherwise, when the vibration table 18*a* is incorporated in the traction bed 10, the top surface 308 may be substantially smooth.

The vibration table 18*a* also includes an actuator 312 supported on the frame 300 and a controller 316 interfaced with the actuator 312. In the illustrated construction of the vibration table 18*a*, the actuator 312 is configured as a linear motor for imparting vibration to the platform 304 in only a single (i.e., vertical) direction relative to the frame of reference of FIG. 11. The actuator can be connected directly to the vibration platform 304 or to a displacement mechanism described below. The controller 316 may independently adjust the frequency and magnitude of vibration imparted to the platform 304 by the actuator 312. The controller 316 may also manipulate the shape of the vibration waveform imparted by the actuator 312 between, for example, a sine wave, a square wave, a sawtooth wave, or a composite waveform of two or more different types of waves. The controller 316 may also be operable to communicate with a remote system to receive control or operational limit inputs based on the records of the individual receiving therapy. In an alternative embodiment, the actuator may comprise a motor with a slider-crank mechanism that can be utilized for constant displacement at all frequencies and that can be mechanically shifted to vary displacement.

With continued reference to FIG. 11, the vibration table 18*a* further includes a displacement mechanism or a linkage 320 positioned between the frame 300 and the platform 304. The linkage 320 includes two primary lever arms 324 arranged in a V-shape, with the ends 326 of the respective arms 324 defining the tip of the "V" being supported by the actuator 312. The arms 324 are supported relative to the frame 300 at a location near the opposite ends 328 of the respective arms 324 by respective pivots 332 on the frame 300. A platform mount 334 is coupled to each of the arms 324 adjacent the end 328. Accordingly, when the actuator 312 imparts an upward displacement to the ends 326 of the lever arms 324, the platform mounts 334 adjacent the respective ends 328 of the lever arms 324 are displaced downward as the arms 324 are rotated about the pivots 332.

The linkage 320 also includes two secondary lever arms 336 coupled, respectively, to the primary lever arms 324. Specifically, each of the lever arms 336 includes a pivot or a hinge at an inboard end 340 to pivotably couple the arm 336 to a middle portion of the arm 324. Each of the lever arms 336 also includes a platform mount 334 adjacent an outboard end 344 of the arm 336. Like the primary lever arms 324, the secondary lever arms 336 are each supported relative to the frame 300 at a location inboard of the outboard end 344 of the respective arms 336 by additional pivots 332 on the frame 300. Accordingly, when the actuator 312 imparts an upward displacement to the ends 326 of the lever arms 324, the inboard ends 340 of the secondary lever arms 336 are also displaced upward, causing the platform mounts 334 adjacent the respective outboard ends 344 of the lever arms 336 to be displaced downward as the arms 336 are rotated about the pivots 332. Therefore, the platform 304, which is supported upon the four platform mounts 334, is displaced downward when the actuator 312 imparts upward movement, and upward when the actuator 312 imparts downward movement. Alternatively, the linkage 320 may be configured such that the platform 304 is displaced downward when the actuator 312 imparts downward movement, and upward when the actuator 312 imparts upward movement. Such single-axis displacement of the platform 304 ensures constant uniaxial (i.e., vertical) acceleration of the platform 304 at all times regardless of an individual's location on the platform 304. The effective lever arm or distance between each of the platform mounts 334 and their corresponding pivots 332 is identical to ensure single-axis displacement of the platform 304. As shown in FIG. 11, the configuration of the linkage 320 permits the actuator 312 to be located proximate one of the sides of the frame 300.

Figure 12:
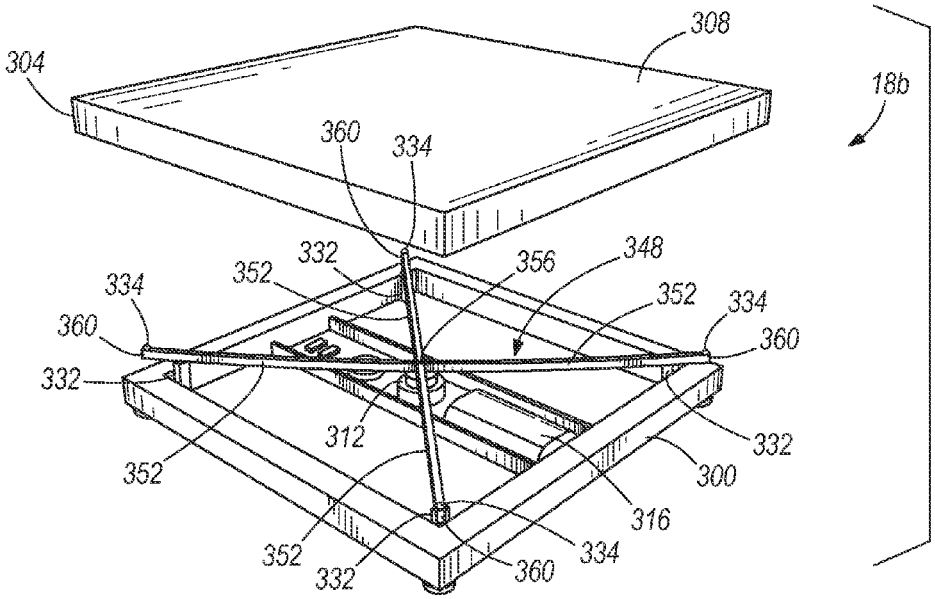
FIG. 12 is a partially exploded, perspective view of another alternative construction of a vibration table of the traction bed of FIG. 1.

An alternative construction of the vibration table 18*b* is shown in FIG. 12, with like components being identified with like reference numerals. The vibration table 18*b*, however, includes a displacement mechanism or a linkage 348 having an "X" shape with the actuator 312 being positioned at the center of the "X." As such, the actuator 312 is positioned in the center of the frame 300 and the linkage 348 includes four identical lever arms 352, each having an inboard end 356 supported on the actuator 312 and an outboard end 360. The pivots 332 are located inboard of the outboard ends 360 of the respective arms 352, in a similar manner as the pivots 332 shown in FIG. 11. In operation of the table 18*b*, therefore, the platform mounts 334 on the respective arms 352 move downward when the actuator 312 imparts upward movement to the inboard ends 356 of the arms 352, and upward when the actuator 312 imparts downward movement to the inboard ends 356 of the arms 352 (FIG. 12). Accordingly, the platform 304, which is supported upon the four platform mounts 334, is displaced downward when the actuator 312 imparts upward movement, and upward when the actuator 312 imparts downward movement. Alternatively, the linkage 348 may be configured such that the platform 304 is displaced downward when the actuator 312 imparts downward movement, and upward when the actuator 312 imparts upward movement. Such single-axis displacement of the platform 304 ensures constant uniaxial (i.e., vertical) acceleration of the platform 304 at all times regardless of an individual's location on the platform 304. The effective lever arm or distance between each of the platform mounts 334 and their corresponding pivots 332 is identical to ensure single-axis displacement of the platform 304.

Figure 13:
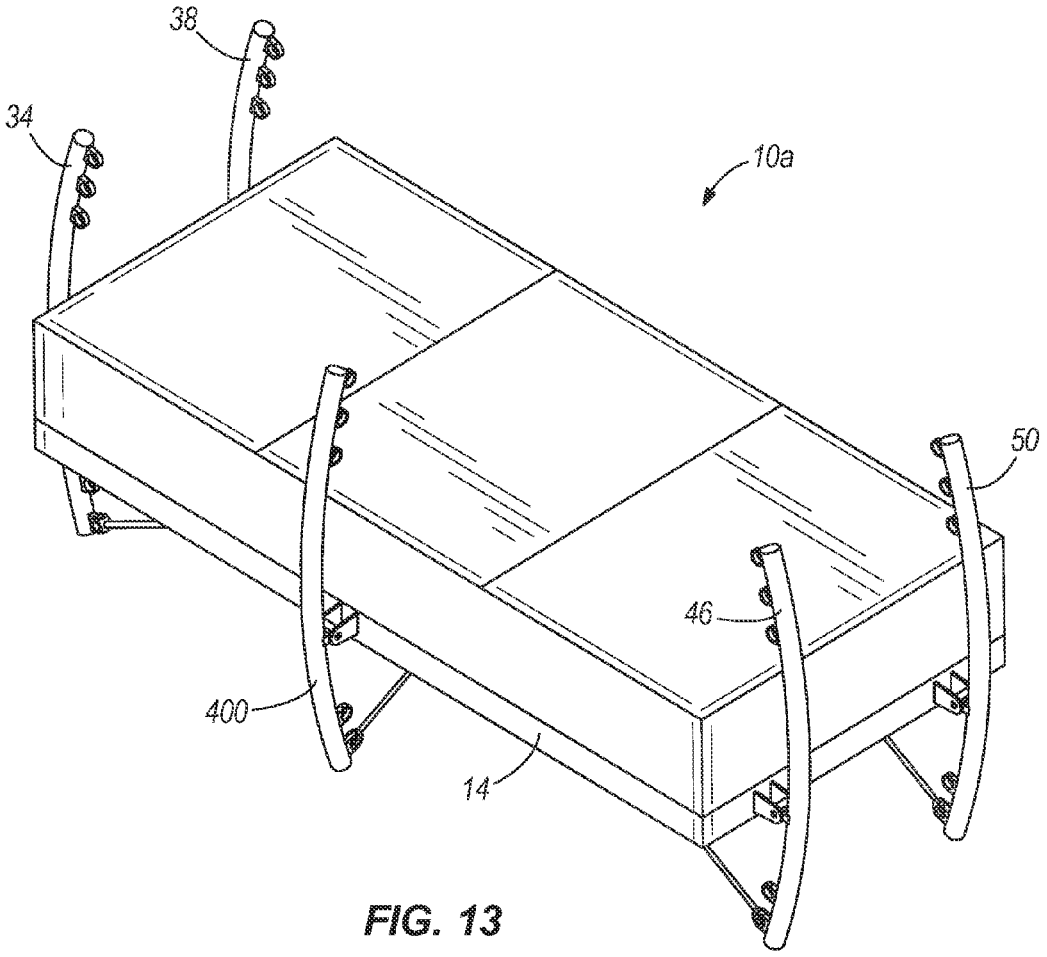
FIG. 13 is a perspective view of a traction bed in accordance with another embodiment of the invention.
Figure 14:
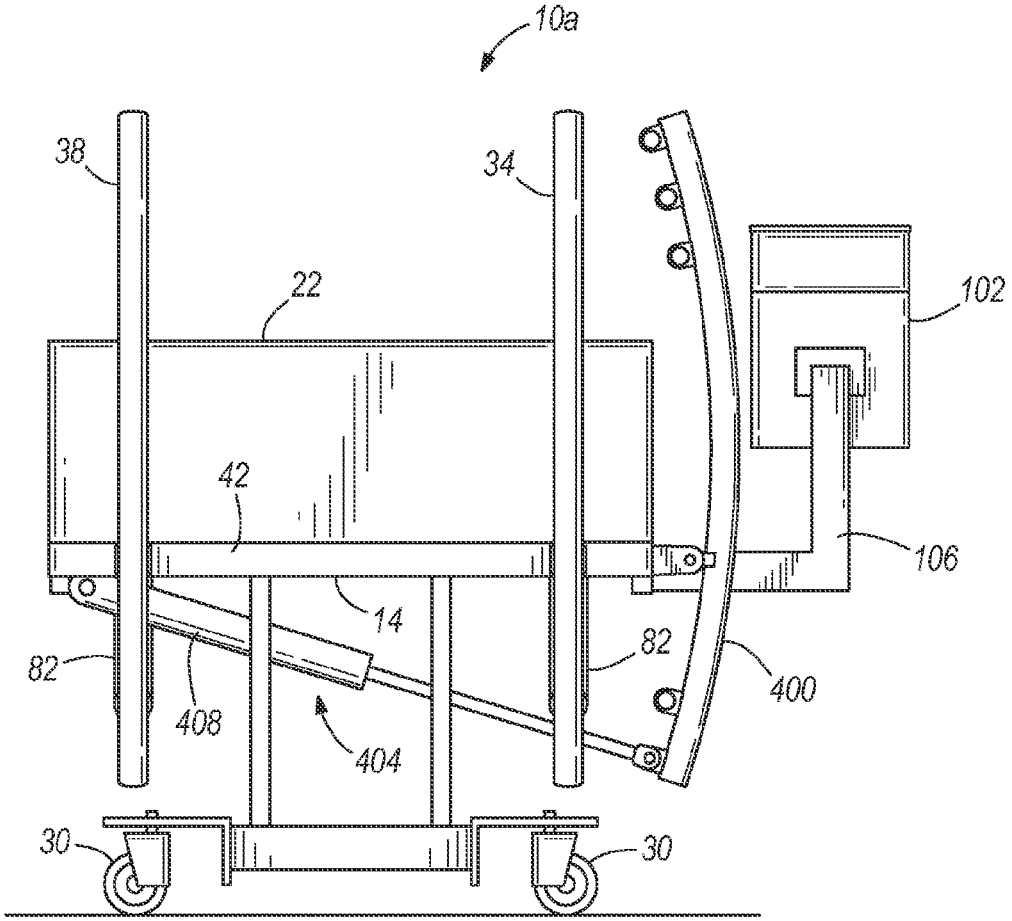
FIG. 14 is a rear view of the traction bed of FIG. 13.

FIG. 13 illustrates a traction bed 10*a* in accordance with another embodiment of the invention. The traction bed 10*a* is identical to the traction bed 10 of FIG. 1, with the exception of another lever arm 400 being coupled to the right side of the frame 14 to impart a lateral traction force on an individual laying on the bed 10*a* Like components are shown with like reference numerals and will not be described again in detail. The lever arm 400 is pivotably coupled to the right side of the frame 14 in the same manner as the lever arms 34, 38, 46, 50 (see also FIG. 14). An extensible member 404, configured as a pneumatic cylinder 408, is coupled to the lever arm 400 such that extension of the cylinder 408 causes the lever arm 400 to pivot in a counter-clockwise direction from the frame of reference of FIG. 14, while retraction of the cylinder 408 causes the lever arm 400 to pivot in a clockwise direction from the frame of reference of FIG. 14. The cylinder 408 may be controlled by the control system 98 independently from the other lever arms 34, 38, 46, 50.

The lever arm 400 may be used independently of the other lever arms 34, 38, 46, 50 to apply only a lateral traction force on an individual's body, or, the lever arm 400 may be used in conjunction with the other lever arms 34, 38, 46, 50 to apply a lateral traction force on an individual's body in addition to a longitudinal traction force being applied by a combination of the levers 34, 38, 46, 50. Although the lateral traction force is exerted on the individual's body in only a single direction with respect to the bed 10*a*, the orientation of the individual may be changed on the bed 10*a* (e.g., by flipping the individual about either a vertical axis or a horizontal, longitudinal axis) such that the lateral traction force may be applied to either the right side or the individual's left side.

Figure 15:
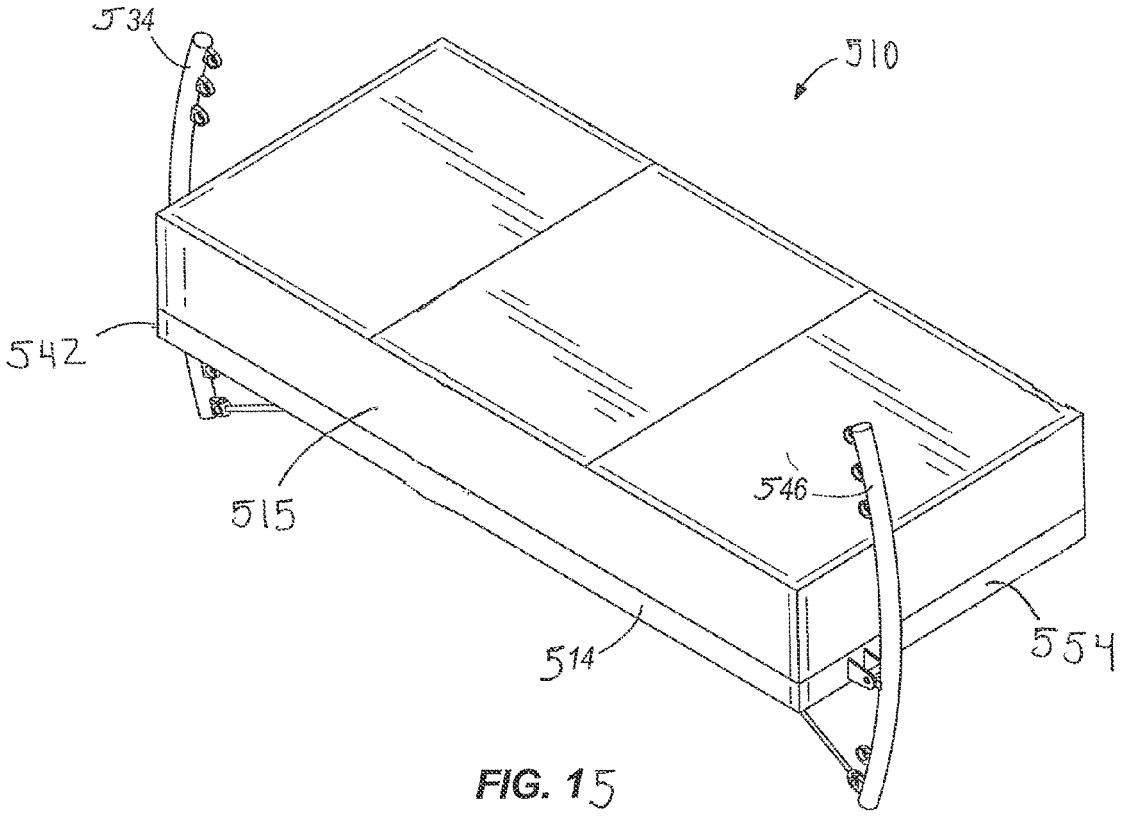
FIG. 15 is a perspective view of a traction bed in accordance with another embodiment of the invention.

FIG. 15 illustrates a traction bed 510 in accordance with another embodiment of the invention. The traction bed 510 is similar to the traction bed 10 of FIG. 1, except that the traction bed employs only a first single-sided lever arm 534 pivotably coupled to the frame 514 at a location proximate a first end 542 of the frame 514 and a second single-sided lever arm 546 pivotably coupled to the frame 514 at a location proximate a second end 554 of the frame 514. Both the first and second single-sided lever arms 534, 546 are located proximate a first side 515 of the traction bed 510. The first and second single-sided lever arms 534, 546 are attached to the frame 514 in the same manner as the first through fourth lever arms 34, 38, 46, 50 described above with respect to FIGS. 1 and 2. Moreover, like components are shown with like reference numerals and will not be described again in detail.

Likewise, the same harness 198 described above with respect to FIGS. 8 and 9 can be used with the single-sided lever arms 534, 546 in the same manner. For example, when a patient's head is oriented toward the first end 542 of the frame 514, the first single-sided lever arm 534 is arranged to connect to an intermediate strap 190 and the second single-sided lever arm 546 is arranged to connect to strap 206. Alternatively, when a patient's head is oriented toward the second end 554 of the frame 514, the first single-sided lever arm 534 is arranged to connect to strap 206 and the second single-sided lever arm 546 is arranged to connect to intermediate strap 190. This arrangement allows traction force to be imparted selectively to either side of the body.

The traction bed 510 includes a control system 198 operable to direct a force (e.g., via pneumatic cylinders (not shown)) onto single-sided lever arms 534, 546 to pivot the lever arms relative to the frame 514. The force directed to the first single-sided lever arm 534 is separately variable from the force directed to the second single-sided lever arm 546 to provide differential traction to the upper torso and pelvis of an individual on a single side of the body.

The control system 98 operates traction bed 510 in a similar fashion as described above with the following differences. Specifically, with reference to FIG. 6, the control system 98 includes a first pressure regulator 110 for varying an air pressure delivered to the pneumatic cylinder 582 associated with the first single-sided lever arm 534 and a second pressure regulator 114 for varying an air pressure delivered to the pneumatic cylinder 582 associated with the second single-sided lever arms 546. In the illustrated construction of the traction bed 510, with an individual's head placed proximate the first end 542 of the frame 514, for example, the first single-sided lever arm 534 is attached, respectively, to the right side of an individual's upper torso via the harness 198 and the strap 190, while the second single-sided lever arm 546 is attached to the right side of the individual's pelvis via the harness 198 and the strap 206. As such, the first pressure regulator 110 determines the air pressure delivered to the pneumatic cylinder 82 pulling (via the first single-sided lever arm 534) on the individual's right upper torso, while the second pressure regulator 114 determines the air pressure delivered to the pneumatic cylinder 82 pulling (via the second single-sided lever arm 546) on the right side of the pelvis. The control system 98 also includes pressure gauges 118 associated with the respective first and second pressure regulators 110, 114.

A further difference includes that when the valve 130 is in the second position, the pneumatic cylinder 582 associated with the first single-sided lever arm 534 communicates with the first pressure regulator 110 to receive a reduced air pressure, while the pneumatic cylinder 582 associated with the second single-sided lever arm 546 is communicated with the third pressure regulator 122 to receive the maximum available air pressure. Likewise, when the valve 130 is in the third position, the pneumatic cylinder 582 associated with the second single-sided lever arm 546 communicates with the second pressure regulator 114 to receive a reduced air pressure, while the pneumatic cylinder 582 associated with the first single-sided lever arm 534 communicates with the third pressure regulator 122 to receive the maximum available air pressure. The combination of the multi-position valve 130 and the three pressure regulators 110, 114, 122 permits a different air pressure to be delivered to the pneumatic cylinder 582 associated with the first single-sided lever arm 534 than that delivered to the pneumatic cylinder 582 associated with the second single-sided lever arm 546. As such, a different force can be exerted on the upper torso of an individual's body via the first single-sided lever arm 534) than that exerted on the pelvis on the same side of the body (e.g., via the second single-sided lever arm 546). The traction bed 510, therefore, is capable of applying a differential traction to the upper torso and pelvis on a single side of an individual's body, permitting a therapist to more precisely isolate a particular muscle or joint within the individual's back to increase the efficiency of the therapy being performed on the individual.

The above detailed description describes various features and functions of the disclosed traction beds and methods with reference to the accompanying figures. While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

Various features of the invention are set forth in the following claims.

What is claimed is:

1. A traction bed comprising:

a frame upon which an individual is supportable;

a first single-sided lever arm pivotably coupled to the frame at a location proximate both a first end of the frame and a first side of the frame, wherein the first single-sided lever arm is configured to be coupled to a location on an upper torso or an arm of an individual;

a second single-sided lever arm pivotably coupled to the frame at a location proximate both a second end of the frame and the first side of the frame, wherein the second single-sided lever arm is configured to be coupled to a location on a lower torso, a pelvis or a leg of the individual; and a control system operable to direct a fluid pressure onto each of the single-sided lever arms to pivot the single-sided lever arms relative to the frame, wherein the control system comprises a valve configured to move between a first position, a second position and a third position such that a fluid pressure directed to the first single-sided lever arm is separately variable from a fluid pressure directed to the second single-sided lever arm.

2. The traction bed of claim 1, further comprising a first extensible member coupling the first single-sided lever arm to the frame; and a second extensible member coupling the second single-sided lever arm to the frame.

3. The traction bed of claim 2, wherein the control system is operable to vary the lengths of the first and second extensible members to pivot the first and second single-sided lever arms relative to the frame, the length of the first extensible member being separately variable from the length of the second extensible member.

4. The traction bed of claim 3, wherein the first and second extensible members are pneumatic cylinders, and wherein the control system includes a first pressure regulator for varying a fluid pressure delivered to the pneumatic cylinder associated with the first single-sided lever arm, and a second pressure regulator for varying a fluid pressure delivered to the pneumatic cylinder associated with the second single-sided lever arm.

5. The traction bed of claim 4, wherein the control system further includes a third pressure regulator positioned upstream of the first and the second pressure regulators, and wherein the third pressure regulator is in fluid communication with a source of pressurized air and operable to set a maximum air pressure capable of being delivered to all of the pneumatic cylinders.

6. The traction bed of claim 5, wherein the first position of the valve is arranged such that all of the pneumatic cylinders are fluidly communicated with the third pressure regulator to receive the maximum air pressure, and the second position of the valve is arranged such that the pneumatic cylinder associated with the first single-sided lever arm is fluidly communicated with the first pressure regulator to receive a reduced air pressure, and the valve is manipulatable from the first position to the second position.

7. The traction bed of claim 6, wherein the valve is also manipulatable from the first position to the third position, in which the pneumatic cylinder associated with the second single-sided lever arm is fluidly communicated with the second pressure regulator to receive a reduced air pressure.

8. The traction bed of claim 5, wherein the first position of the valve is arranged such that all of the pneumatic cylinders are fluidly communicated with the third pressure regulator to receive the maximum air pressure, and the third position of the valve is arranged such that the pneumatic cylinder associated with the second single-sided lever arm is fluidly communicated with the second pressure regulator to receive a reduced air pressure, and the valve is manipulatable from the first position to the third position.

9. The traction bed of claim 1, further comprising a vibration table positioned on the frame upon which at least a portion of the individual is supportable.

10. The traction bed of claim 9, wherein the vibration table includes a platform movably coupled to the frame, and a vibration device coupled to the platform.

11. The traction bed of claim 10, wherein the vibration device includes an electric motor and a counterweight assembly driven by the motor.

12. The traction bed of claim 11, wherein the control system includes a switch operable to vary a speed of the motor and therefore a frequency of vibration generated by the counterweight assembly.

13. The traction bed of claim 10, wherein the vibration device includes an actuator for displacing the platform in a reciprocating manner along a single axis.

14. The traction bed of claim 10, wherein the vibration table includes a linkage positioned between the frame and the platform, wherein the platform is supported upon the linkage and the platform's motion is primarily restricted along a single axis as a result.

15. The traction bed of claim 13, wherein the actuator comprises a linear motor, wherein the control system includes a controller for independently adjusting a frequency and a magnitude of vibration imparted to the platform by the linear motor.

16. A traction bed comprising:

a frame upon which an individual is supportable;

a first level arm and a second lever arm each pivotably coupled to the frame at a location proximate a first end of the frame and configured to be coupled to one or more locations on an upper torso or arms of an individual;

a third level arm and a fourth lever arm each pivotably coupled to the frame at a location proximate a second end of the frame and configured to be coupled to one or more locations on a lower torso, a pelvis or legs of the individual;

a control system operable to direct a force onto each of the lever arms to pivot the lever arms relative to the frame, wherein the force directed to each of the lever arms is separately variable; and a fifth lever arm coupled to the frame at a location proximate a side of the traction bed and configured to be coupled to a location on the individual and to impart a lateral traction force on the individual.

17. A vibration table comprising:

a frame;

a platform movably coupled to the frame;

a vibration device;

a linkage positioned between the frame and the platform, wherein the platform is supported upon the linkage, wherein the vibration device is coupled to one of the platform or the linkage for displacing the platform primarily along a single axis, wherein the linkage comprises four lever arms, wherein the vibration device is located in a center of the frame, wherein the four lever arms are arranged in an X-shape such that each lever arm has a first end supported on the vibration device and a second end supported on a pivot coupled to the frame or supported by the platform; and a controller for independently adjusting a frequency and a magnitude of vibration imparted to the platform by the vibration device.

* * * * *